United States Patent [19]

Stallings, Jr.

[11] 3,976,838

[45] Aug. 24, 1976

[54] HIGH FIDELITY SOUND REPRODUCTION SYSTEM

[76] Inventor: Robert J. Stallings, Jr., P.O. Box 230, Sugar Land, Tex. 77478

[22] Filed: July 9, 1973

[21] Appl. No.: 377,762

[52] U.S. Cl. ..... 179/1 E; 181/153

[51] Int. Cl.[2] ..... H04R 1/28

[58] Field of Search ..... 179/1 E; 181/31 B, 145, 181/147, 153, 198, 199

[56] References Cited

UNITED STATES PATENTS

| | | | |
|---|---|---|---|
| 2,632,055 | 3/1953 | Parker | 179/1 E |
| 2,915,588 | 12/1959 | Bose | 179/1 E |
| 3,719,250 | 3/1973 | Maekawa | 181/31 B |

*Primary Examiner*—Kathleen H. Claffy
*Attorney, Agent, or Firm*—Roy H. Smith, Jr.

[57] ABSTRACT

A combination of loudspeakers, primary enclosures for individual loudspeakers, and a secondary enclosure or baffle for the entire array. The loudspeakers are preferably all of the same size, and the same is true of the primary enclosures. Although other shapes may be used to advantage, each primary enclosure is preferably a spherical shell of hard material such as metal, glass or a rigid plastic, having a diameter limited only by practical considerations to two to three times the diameter of the loudspeaker. Each such enclosure is provided with an opening in which a loudspeaker is mounted in such manner as to completely fill the opening; otherwise the primary enclosure is left unvented, although it may be provided with a capped opening for access to the speaker and wiring.

The secondary enclosure is preferably a second spherical shell, albeit of much larger diameter, and made of a similar hard material. All of the modules, each consisting of a primary enclosure and speaker, are mounted on the wall of the secondary enclosure with the speaker being tangent to the larger diameter outer spherical shell.

6 Claims, 14 Drawing Figures

HIGH FIDELITY SOUND REPRODUCTION SYSTEM

FIELD OF INVENTION

The present invention lies broadly in the field of acoustic devices and, more particularly, in combinations of loudspeakers and loudspeaker enclosures. They constitute the terminal units of a sound reproduction system in which the penultimate units are one or more sound amplifiers, and of course the original sound to be reproduced may be human speech, musical instruments, etc., whether recorded and replayed, or directly through a broadcasting-receiving system or a public address system. The invention provides a faithful reproduction of the original sound at all audible frequencies, and in all directions from the sound reproduction system, both with respect to loudness and phase of the input signal.

PRIOR ART

The excellent loudness characteristic over most of the audible frequencies of a combination of a direct radiating loudspeaker disposed in the wall of a much larger spherical shell, at least on the axis of the loudspeaker, has long been known; see the article "Direct Radiator Loudspeaker Enclosures" by Harry F. Olson, on pp. 22–29 of *The Journal of the Audio Engineering Society*, Vol. 17, No. 1, January, 1969. A somewhat similar module is disclosed in U.S. Pat. No. to Wilber, 3,026,955, issued in 1962, although Wilber asserts that several loudspeakers may be used with a single spherical shell. He also teaches the use of a sound-absorbing lining on the inner surface of his spherical shell, an addition applicant has found to be unnecessary. Despite these disclosures, loudspeaker-spherical shell modules are not to be found on the commercial market nor found in use in sound reproduction systems, nor are spherical enclosures available or in use apart from the loudspeakers themselves. In addition, no combinations of such modules, either identical in size or combinations of different sizes, have ever been known or published, and the same is true of modules using enclosures other than spherical shells.

To obtain high fidelity sound reproduction, three characteristics must be present in the reproduced sound available to the listener. First, the loudness of each frequency present in the usually complex sound wave must bear the same relationship to the other frequencies as such relationships exist in the original sound. Secondly, the nature of the sound must remain the same or, in other words, only those frequencies should be present at the point of observation as were combined in the original sound. Thirdly, the observed sound must be free of the distortions introduced by time delays in some but not all of the components of the original sound, i.e., the observed sound must be free of phase shifts. Stated negatively, high fidelity reproduction requires an absence of distortion, whether that distortion is a suppression of some components of the original sound, resonance or building up of others, the introduction of spurious and undesired sounds, or a combination of any of these.

In addition to the above requirements, a good sound reproduction system is relatively non-directional, reproducing the original sound faithfully in all reasonable directions from the source through which the sound is reproduced. This requirement will vary with the physical situation, requiring even dispersion through 360° when the setting is a circular theater or stadium, and considerably less when the sound is being projected from the stage of a rectangular parallelepiped-type of theater.

These requirements are not being adequately met by the sound reproduction systems now in use and available to the consumer. The best of the presently available systems use a combination of low frequency loudspeakers ("woofers") and high frequency loudspeakers ("tweeters") linked together by a crossover network which amounts to placing the high frequency loudspeaker in series with a high-pass filter and placing the low frequency loudspeaker in series with a low-pass filter, the net result being that virtually all of the sound components above a "crossover" frequency pass through the small size high frequency loudspeaker while all of the components below such frequency pass through the low frequency loudspeaker. Quite commonly an intermediate frequency loudspeaker is also used, together with a second crossover network.

Even in the best of these systems, phase distortion at the crossover frequencies is unavoidable, and typically there are dips in the loudness response characteristic as well. Both the crossover components and the transducers (loudspeakers) contribute distortions of one kind or another, so that the observed sound is not a faithful reproduction of the original sound. In addition, most such systems are highly unidirectional, giving the best results when the listener is located in some critical spot, such as on a plane bisecting the distance between the two speakers.

In addition, prior art systems are characterized by low frequency drop-off, i.e., the bass frequencies are suppressed or attenuated while the higher frequencies come through at a closer approximation to their original loudness levels.

OBJECTS OF THE INVENTION

The primary object of the present invention is to provide a high fidelity sound reproduction system which is free of the shortcomings of prior art systems.

Another object is to provide such a high fidelity system providing an excellent loudness-frequency characteristic over the full band of audible frequencies, with no drop-off at lower frequencies and without any peaks or points of resonance at particular frequencies.

A further object is to provide such a system which is omnidirectional, furnishing the same high fidelity reproduction at points off the axis of the system as it does on the axis.

Another object is to provide such a high fidelity sound reproduction system which makes use of the loudspeaker-individual enclosure modules known to the prior art, particularly the spherical shell enclosure and near approximations thereto.

Yet another object is to provide such a high fidelity system using multiple, standardized components wherein the primary enclosure is the same from one module to the next and identical loudspeakers are also used, thus reducing the cost of the system considerably in comparison with the woofer-tweeter combinations of the prior art.

Still another object is to provide such a system where essentially the same size loudspeakers are used to reproduce all audio frequencies and no crossover network, electrical or mechanical, are employed.

Other objects are to take advantage of the superior characteristics of loudspeakers smaller than woofers by using only such smaller loudspeakers in the systems of the present invention, to take advantage of the greater strength and vibrationless nature of curved enclosures by comparison with rectangular shapes, and to use transparent or translucent materials for the secondary enclosure so that they may house lighting units to produce novel and aesthetic effects.

SHORT STATEMENT OF THE INVENTION

In this invention, applicant makes use of standard modules using primary enclosures of the same size and loudspeakers which are identical to one another in all respects, e.g., a 9-inch diameter Plexiglas enclosure using a 4-inch diameter moving coil loudspeaker. The most appropriate loudspeakers are made according to design disclosed in a separate patent application to be filed by the present applicant, but more conventional and presently commercially available loudspeakers may also be employed, e.g., a 4-inch Harold S-324A loudspeaker manufactured for the Harold Electronics Company of Chicago, Ill. This speaker uses a paper cone driven by a voice coil which floats in the gap or a fixed electromagnet, has an impedance of 8 ohms and a continuous input of 5 watts, with a peak power rating of 15 watts. This speaker was mounted in an opening formed in a Plexiglas sphere of 9 inches outside diameter and with a wall thickness of 3/16 inch, the speaker being mounted in the wall to effect a seal which completely closed the opening.

It was known to applicant that it is highly undesirable to mount more than one loudspeaker in a single primary enclosure. Regardless of whether two speakers are hooked together in series or parallel (or series-parallel for more than two), and regardless of whether they are driven by the same or separate amplifiers, invariably the loudness-frequency characteristic is less desirable than that of a single speaker and enclosure. In a particular test, the characteristics using more than one speaker per enclosure showed a marked fall-off in loudness response for the frequencies below 800 Hz. This result seems to follow from the interaction of the backward sound waves produced inside the enclosure from the back side of the loudspeaker diaphragms. The air currents collide with one another, and also induce electromagnetic interactions which cancel one another at the low frequencies. While it might be thought that such clashing interaction would be confined to the interior of the sphere and not made manifest to the listener on the outside of the spherical enclosure, the results contradict this assumption. Evidently the interaction within the sphere feeds back into the signal source and causes all sorts of distortions in the current fed through the voice coil and thus the air currents which constitute the observed sound on the outside surface of the vibrating diaphragm. In short, there is no economy in using more than one loudspeaker per enclosure, but on the contrary the second and any other loudspeakers added to the first are not only wasted but detract from the performance of the first loudspeaker.

Applicant's further discoveries were that there is a synergistic effect in combining two or more modules, each a loudspeaker and separate primary enclosure combination, mounted on a common baffle. This baffle may take the form of a simple flat wall, although directionality is improved by bending the wall until it forms a spherical wall of several times the diameter of the primary enclosure. Both the common baffle and the addition of further modules, each contributing by itself, increase the fidelity of the base response characteristic.

These discoveries are incorporated in a structure which comprises a number of the individual loudspeaker-primary enclosure modules disposed in the wall of a considerably larger enclosure, preferably a sphere or a portion thereof, both the secondary and the primary enclosures preferably being spherical shells of a hard material such as glass, metal or rigid plastic. The speakers are wired to a common output amplifier in such a manner that the same power is delivered to each of the identical loudspeakers and, since each loudspeaker is identical to the others, each presents the same impedance to the amplifier. Thus it is immaterial whether the wiring arrangement be a parallel, series or series-parallel arrangement. Each module is disposed so that the bulk of it lies inside the wall of the large enclosure and with the speaker diaphragm tangent (or forming a chord) to the larger shell. They are preferably disposed close to one another, but not touching, and thus face in slightly different directions. This method of disposing the modules makes the overall system omnidirectional, and another factor contributing to the same result is the use of a common baffle formed by the large diameter enclosure.

BRIEF DESCRIPTION OF THE DRAWING FIGURES

The present invention can be better understood by reference to the accompanying drawing, in which.

DETAILED DESCRIPTION OF THE DRAWING FIGURES

Figure 3:
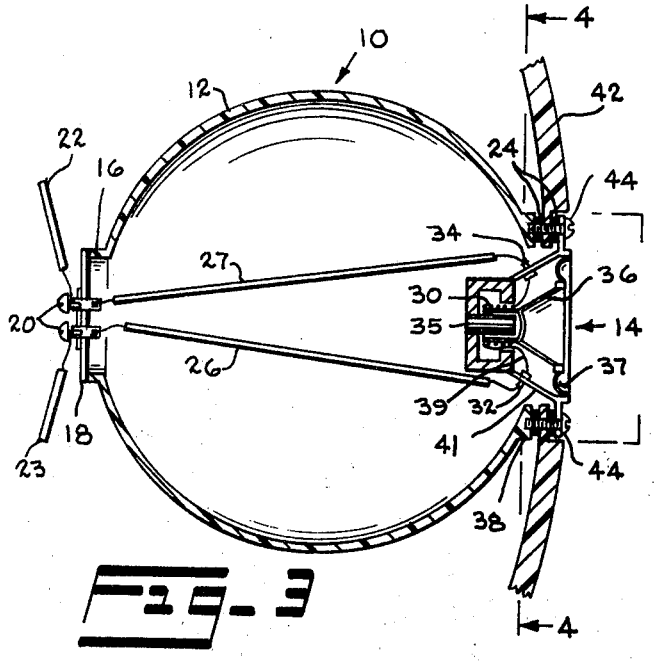
FIG. 3 is a longitudinal section through a portion of the secondary enclosure and one of the modules of the same embodiment, as indicated by the section lines and arrows labeled 3—3 in FIG. 1, somewhat enlarged.
Figure 4:
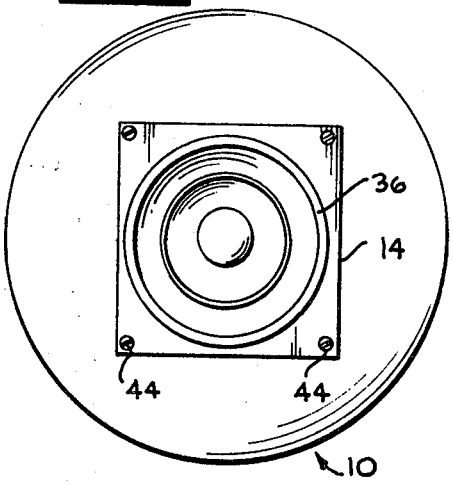
FIG. 4 is a front view of the single module of FIG. 3, as indicated by the lines and arrows labeled 4—4 therein, with the large secondary enclosure removed.

In the preferred embodiment of FIGS. 1–5, there are four individual modules 10 supported by the wall 42 of a common secondary enclosure 40. Each module 10 comprises a loudspeaker 14 and a spherical shell 12 of a hard material such as glass or rigid plastic in a thickness, for instance, of 3/16 inch, and a diameter of 9–12 inches for a 4 inch speaker. The secondary enclosure defined by the larger spherical shell 42 may be made of the same hard material, and may have a diameter, for instance of 2 ½ to 3 feet in an average size room. In addition to the forward opening receiving loudspeaker 14, the small spherical shell 12 has a rearward opening defined by the upstanding boss 16. This boss is provided with a cap 18 which closes the opening and is provided with a pair of metal terminals 20. The outwardly projecting portion of each terminal 20 is connected to one of the leads 22 and 23 from the other speakers, while on the inside of this sphere the terminals 20 are connected to a pair of leads 26 and 27 having their opposite ends connected to the voice coil 30 of the speaker through speaker connections 32 and 34.

To mount the module 10 on the secondary enclosure 40, the speaker opening in shell 12 is provided with a thickened square boss 38 in the corners of which four blind holes are drilled and tapped. A similar set of registering holes are drilled in the wall 42 of the secondary enclosure, and the two enclosures and loudspeaker are secured together by a multiplicity of threaded connecting members such as machine screws 44. A pair of gaskets 24 are also provided, to dampen sound transmission through the enclosures and to seal the speaker against the flow of air from the inside of the primary enclosure 12 to the space in front of the assembly.

It may be noted here that, with an assembly having minimal air leakage, it may be necessary to provide a very small opening, less than 1/16 inch in diameter, in the wall of primary enclosure 12. The purpose of such an opening (not shown) would be to allow just enough air flow to assure that the air pressure within the primary enclosure adjusts itself to equal the ambient barometric pressure and any changes therein. This would generally be unnecessary with presently available loudspeakers, but one made very leaktight would require such a pressure equalizing opening. The secondary enclosures are generally open at the rear, but if either made complete or sealed to a wall a similar small opening may be provided in wall 42.

The loudspeaker 14 may be conventional dynamic type of speaker employing the fixed magnet 35, the voice coil 30 operating in the air gap between parts of the magnet 35, paper cone diaphragm 36 having its truncated apex secured to one end of the voice coil 35, and the usual flexible supports 37 and 39 at outer and inner ends of the diaphragm, respectively, securing the diaphragm loosely to the metal framework 41 of the speaker.

Figure 5:
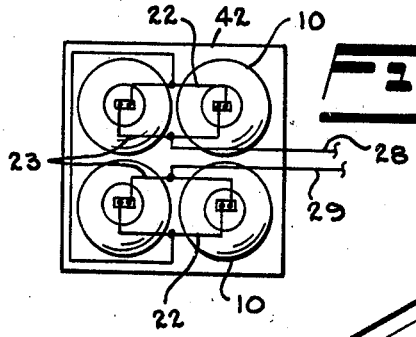
FIG. 5 is a somewhat schematic rear elevation of the FIG. 1 embodiment in reduced scale, with wiring added to indicate one technique for linking the four speakers together to a common audio amplifier.
Figure 2:
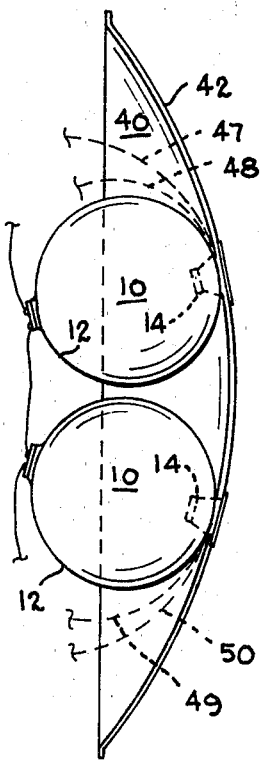
FIG. 2 is a top view of the same embodiment, as indicated by the lines and arrows labeled 2—2 in FIG. 1.
Figure 1:
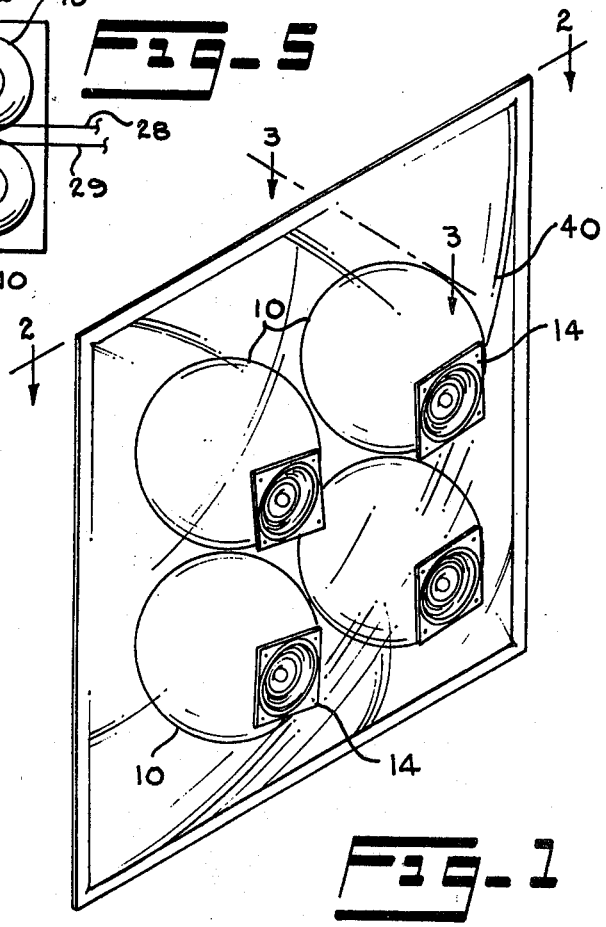
FIG. 1 is a perspective view of a preferred embodiment of the invention, showing four loudspeaker-spherical shell modules disposed in a secondary enclosure consisting of a rectangular portion of a larger spherical shell.

As indicated schematically in FIG. 5, the four speakers of the array may be linked together electrically by the series-parallel arrangement shown, wherein the two upper speakers are connected in parallel with each other, and likewise for the two bottom speakers. The two pairs are then linked together in series, so that the net impedance presented to the audio amplifier through leads 28 and 29 is equal to the impedance of a single speaker, which is made possible by using identical speakers having the same impedance. All of the wiring may be done through the openings in the rear of the primary enclosures, as shown in FIG. 3 and in the full outlines of FIG. 2, but alternately the rear openings may be omitted and the wiring fed to the voice coils through the forward openings in the enclosures 10, as indicated by the phantom wires 47, 48, 49 and 50 of FIG. 2.

The modified forms of the invention shown in FIGS. 6–7 and 8–9 simply present alternate embodiments of applicant's basic concept, that of mounting an array of speakers so that each loudspeaker has the back face of its diaphragm disposed in a closed cavity, preferably spherical, and mounting the array of speakers so that the forward faces of all of the diaphragms are secured to a larger, common enclosure, preferably having an outwardly convex surface, either curvilinear or free of sharp angles. In the previously described embodiment, each speaker was connected to a smaller spherical shell to form a module, and the modules were then mounted on a larger spherical shell. There is no reason, however, why the member defining the larger shell cannot be made thick enough so that it can partially or wholly define the primary cavities in which the individual speakers are disposed.

Figure 6:
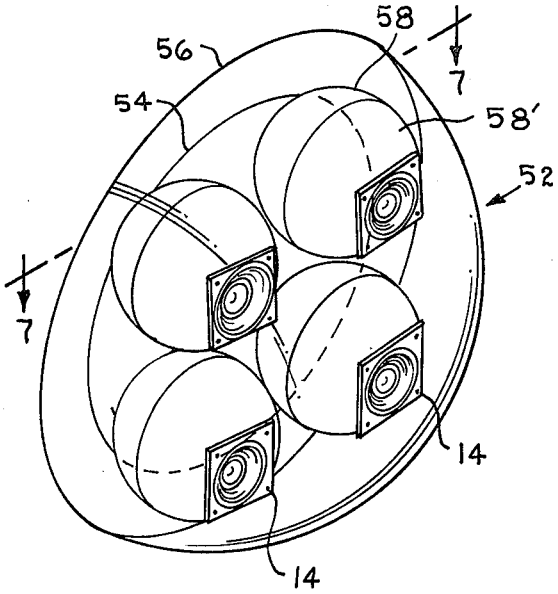
FIG. 6 is a perspective view of a four-speaker assembly of somewhat modified form, using a thicker secondary enclosure which also defines the separate primary enclosures for the four speakers.
Figure 7:
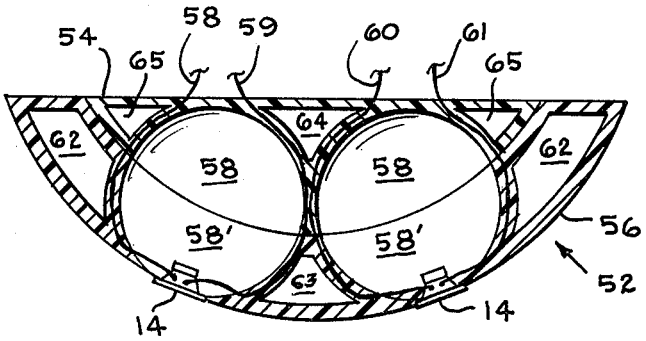
FIG. 7 is a cross-section of the FIG. 6 embodiment, as indicated by the lines and arrows labeled 7—7 therein.

In the FIGS. 6–7 embodiment, the overall enclosure 52 consists of two parts, an inner sector 54 and an outer spherical shell 56. The inner portion or spherical sector 54 has formed therein a multiplicity of hemispherical cavities 58, and a like number of hemispherical cavities 58′ are formed in the outer member 56. These cavities are formed to the same diameter, of course, and are disposed so that for each hemispherical cavity 58 there is a registering cavity 58′ which mate with each other when the two parts 54 and 56 are secured together. The speakers 14 may be mounted directly in the wall of the outer member 56, as indicated. The various speaker leads 58–61 may be passed to the rear through the interior of the primary enclosures 58–58′ to terminals in rearwardly mounted caps, as in the earlier described embodiment, or may be embedded in the material defining the walls, as shown in the drawing. While not shown in detail, these electrical connections may be joined at the interface between the two portions of the enclosure by a jackplug arrangement which would also serve as a means of centering the two portions when they are being connected together.

As indicated in the drawings, the FIGS. 6–7 embodiment may have additional openings 62–65 formed in the spherical sector 54 and spherical shell 56 at the time of fabrication. These additional openings simply reduce the weight and thus the overall cost of the assembly.

Figure 8:
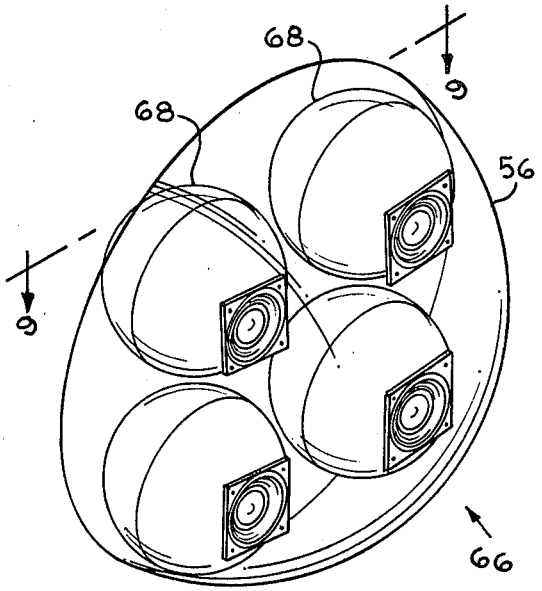
FIG. 8 illustrates a second modification for combining the primary enclosures and the secondary enclosure, this form of the invention using a secondary enclosure which defines the outer portions of the primary enclosures and using individual hemispheres to define the rear portions of the primary enclosures.
Figure 10:
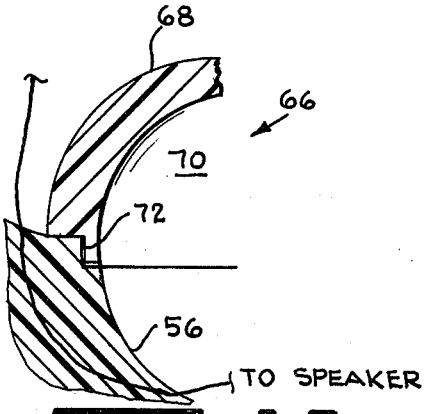
FIG. 10 is a cross-sectional detail of the FIGS. 8–9 embodiment, showing how the individual hemispheres of the primary enclosures are fitted to the common secondary enclosure which defines the balance of the primary enclosures.
Figure 9:
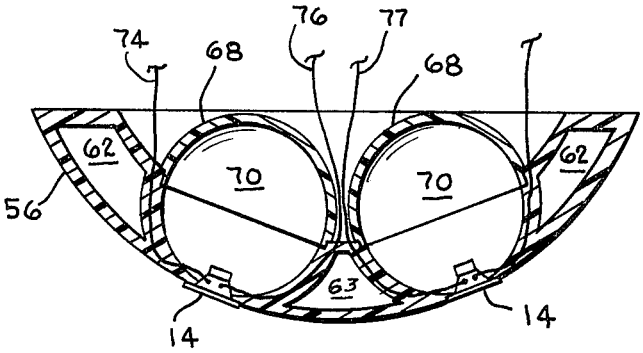
FIG. 9 is a cross-section of the FIG. 8 embodiment, as indicated by the lines and arrows labeled 9—9 therein.

In the FIGS. 8–10 embodiment, the overall enclosure 66 is something of a hybrid of the two earlier described embodiments. It includes an outer spherical shell 56 which may be identical to that of the FIGS. 6–7 embodiment, but rearwardly therefrom each of the individual primary enclosures is completed by individual hemispherical shells 68. These are fitted to the outer portion as shown in detail in FIG. 10, with the annular shiplap fit indicated at 72. As in the previously described embodiment, the hemispherical cavities fit together to define a closed spherical cavity in which the back of the diaphragm of speaker 14 operates. The speaker leads 74–78 may be led to the rear as before, either through a cap or, as illustrated, by embedding them in the wall material of the enclosure.

Figure 11:
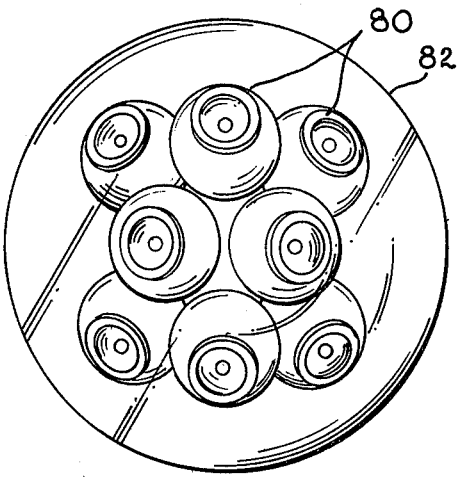
FIG. 11 is a front elevation of an array of eight individual speaker-spherical shell modules supported in a common secondary enclosure.
Figure 12:
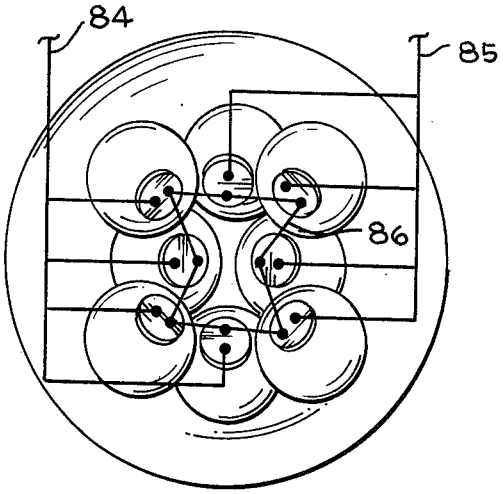
FIG. 12 is a rear elevation of the same eight-speaker assembly, indicating schematically in series-parallel circuitry.
Figure 13:
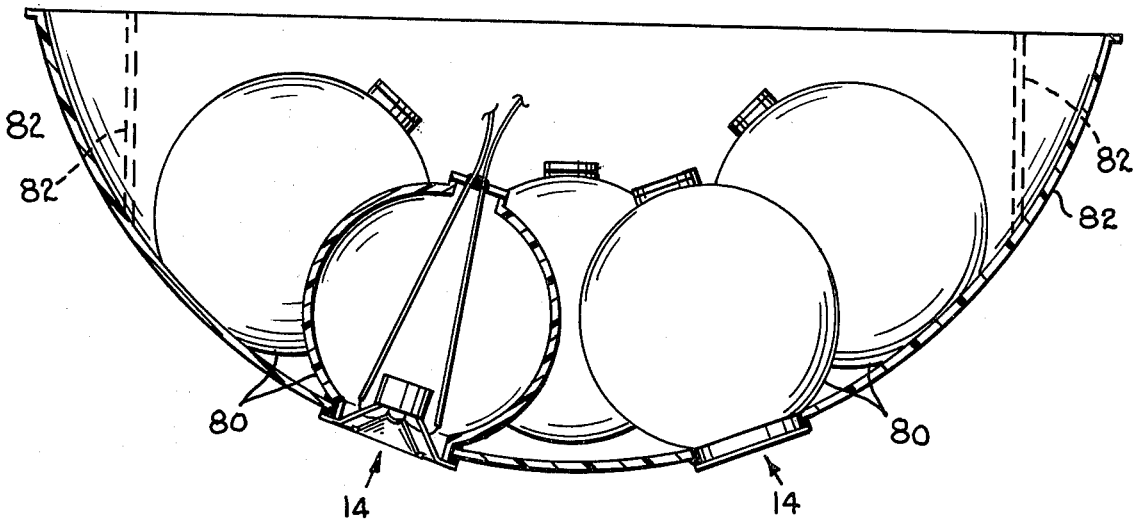
FIG. 13 is an enlarged diametral cross-section of the same embodiment as is shown in FIGS. 11 and 12.

FIGS. 11, 12 and 13 simply illustrate that the number of speakers supported on a common baffle or secondary enclosure is not limited; in fact, it is desirable to have a larger number. In this embodiment there are eight speaker-spherical shell modules 80 supported on a common baffle 82, the latter preferably of curvilinear form and in particular a larger diameter sphere. This embodiment is similar to that shown in FIGS. 1–5, except that a larger common baffle 82 is employed. In a cramped space situation, the extremities of baffle 82 may be bobtailed, as indicated in phantom.

Figure 14:
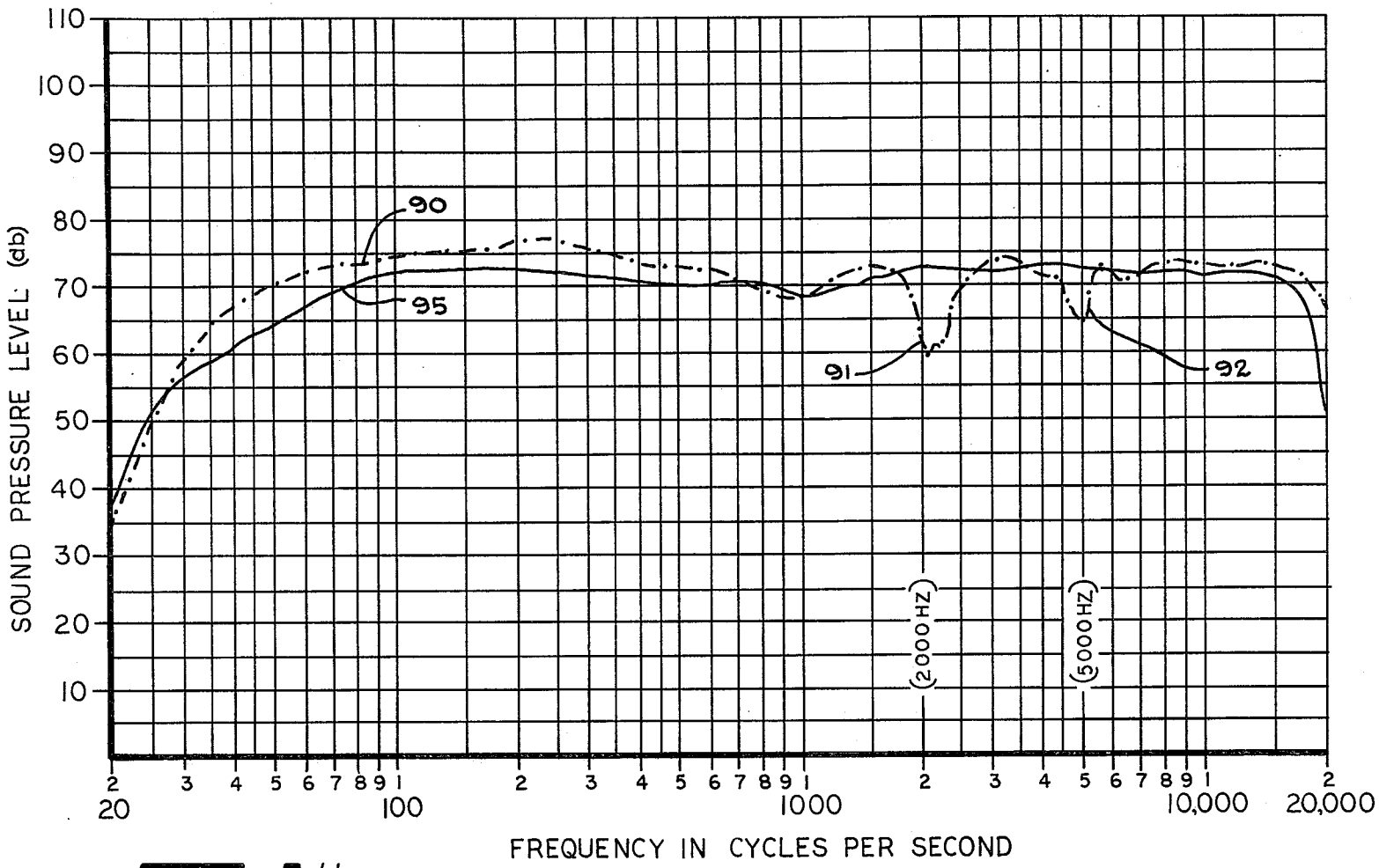
FIG. 14 is a graph setting forth the loudness response characteristics of both a prior art loudspeaker system and that of an embodiment of the present invention.

In FIG. 14, curve 90 indicates a typical loudness response characteristic of a prior art system using one each woofer, tweeter and intermediate frequency loudspeaker; it will be noted that this system exhibited decided dips 91 and 92 in response at about 2,000 Hz and 5,000 Hz, which correspond to the crossover frequencies. Curve 95, on the other hand, illustrates test results obtained with a sound reproduction system of the type illustrated and described above, using eight 5-inch speakers as illustrated in FIGS. 11–13. It will be noted that this response curve is virtually flat over the full range of audio frequencies.

In the primary enclosures of the present invention, those defining such cavity shapes as cubical, parallelepiped, pyramidal, etc., and such curved shapes as paraboloid, ellipsoidal, etc., are within the spirit of the present invention. While none of them is as desirable as the spherical shape, each will contribute to superior results when the overall embodiment embraces the twin concepts of combining one speaker in one cavity to form a module and operating identical or virtually identical modules in tandem.

The secondary enclosure or baffle is used to mount all the modules, and is preferably of as large a size as is practical, presenting to the observer a shape which is generally described as outwardly convex. While such shape is preferably curved, it is within the spirit of the invention to use such shapes as multi-faceted polygons, etc., wherein the intersections between faces do not form any of the sharp corners which are likely sources of distortion.

What is claimed is:

1. In a sound reproduction system, an enclosure-baffle assembly having an outwardly convex baffle surface and a multiplicity of inwardly disposed closed cavities intersecting said baffle surface in openings, of approximately the same size, and a like multiplicity of intermediate size loudspeakers disposed in said cavities with their diaphragms in said openings, one loudspeaker per cavity, each said loudspeaker being secured to the enclosure-baffle assembly to fill said opening and with the back face of its diaphragm operating into said cavity, said loudspeakers being electrically linked together for simultaneous reproduction of a common input signal.

2. The improved sound reproduction system of claim 1 in which said enclosure-baffle assembly consists of a multiplicity of primary enclosures each receiving a loudspeaker to form a module and a larger secondary enclosure having said outwardly convex baffle surface thereon and said openings therethrough, said modules being secured to said secondary enclosure so that said loudspeakers are disposed in the openings therein.

3. The improved sound reproduction system of claim 1 in which said enclosure-baffle assembly consists of two parts secured together, each said part having a portion of each of said closed cavities and one of them having the openings receiving the diaphragms of said loudspeakers.

4. The improved sound reproduction system of claim 1 which consists of an outer part having said baffle surface, said openings, and the outer portion of each of said cavities, together with a multiplicity of inner parts each including the inner portion of one of said cavities, said outer part and inner parts being secured together to close said cavities and receiving the loudspeakers therein with their diaphragms disposed in said openings.

5. The improved sound reproduction system of claim 1 in which said baffle surface is approximately spherical.

6. In a sound reproduction system, a multiplicity of loudspeakers each of approximately the same size and characteristics and an enclosure system mounting said loudspeakers on a common baffle plate of large diameter, said enclosure system also including a multiplicity of smaller diameter spherical cavities equal to the number of loudspeakers, said loudspeakers being mounted on the common baffle plate so that the rear face of the diaphragm of each loudspeaker faces into a separate one of said spherical cavities, and also being electrically connected for simultaneous reproduction of a common input signal.

* * * * *

UNITED STATES PATENT OFFICE

CERTIFICATE OF CORRECTION

Patent No. 3,976,838 Dated August 24, 1976

Inventor(s) Robert J. Stallings, Jr.

It is certified that error appears in the above-identified patent and that said Letters Patent are hereby corrected as shown below:

Column 3, line 17, "according to" should read -- according to a --.

Column 4, line 3, "base" should read -- bass --.

Column 5, line 66, "may be" should read -- may be a --.

Column 8, line 7, "openings," should read -- openings --.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*